US005670763A

United States Patent [19]

Spencer

[11] Patent Number: 5,670,763

[45] Date of Patent: Sep. 23, 1997

[54] DEAD FRONT INTERLOCKED RECEPTACLE

[75] Inventor: Charles Jeffrey Spencer, Chicago, Ill.

[73] Assignee: S-B Power Tool Company, Chicago, Ill.

[21] Appl. No.: 683,581

[22] Filed: Jul. 15, 1996

[51] Int. Cl.[6] ..... H01H 9/28

[52] U.S. Cl. ..... 200/43.16; 200/43.01; 200/318

[58] Field of Search ..... 200/43.16, 43.19, 200/43.01, 43.02, 43.04, 43.05, 43.07, 43.08, 318, 320, 321, 323, 324, 325; 438/258

[56] References Cited

U.S. PATENT DOCUMENTS

| | | | |
|---|---|---|---|
| 4,481,388 | 11/1984 | Gillam et al. . | |
| 4,506,121 | 3/1985 | Peterson et al. . | |
| 4,563,049 | 1/1986 | Thibeault . | |
| 4,899,021 | 2/1990 | Daniel | 200/43.16 |
| 5,212,624 | 5/1993 | Johnson et al. . | |
| 5,558,210 | 9/1996 | Jonischus | 200/318 |

OTHER PUBLICATIONS

Crouse–Hinds Dead Front Receptacle Dec. 6, 1995.

*Primary Examiner*—David J. Walczak
*Attorney, Agent, or Firm*—Jones, Day, Reavis & Pogue

[57] ABSTRACT

An actuator shaft has an external end mounting a handle adjacent the dead front receptacle and an internal end contained within the fixture housing. An actuator arm is mounted on the inner end of the actuator shaft. A spring urges the actuator shaft in a first rotary direction from a first position to a second position. When the actuator shaft is in its first position, the actuator arm is in an interfering relationship with an interlock rod thus preventing the disconnect switch from being turned on. A slider has one end thereof projecting into the cylindrical opening of the dead front receptacle. The other end of the slider includes an opening receiving the actuator shaft in the vicinity of a first slot; the slider opening defines cam follower formations engageable with a planar surface defined by the first slot. Insertion of a plug causes the slider to move such that the actuator or shaft may rotate under the influence of the spring from its first position to its second position. This rotation of the actuator shaft causes (1) a locking pin to be engaged with an aperture in the plug thus preventing removal of the plug and (2) the actuator arm to be moved out of interfering relationship with the interlock rod.

4 Claims, 6 Drawing Sheets

DEAD FRONT INTERLOCKED RECEPTACLE

The present invention relates to an electrical fixture with a dead front receptacle. More particularly, the present invention relates to an interlock mechanism for such a device.

BACKGROUND OF THE INVENTION

Explosion-proof fixtures are used in industrial environments containing hazardous substances like dust particles and gases. An electrical device such as a power source receptacle or switch is an arcing device, and sparks produced thereby may ignite the particles or gases to cause an explosion. Therefore, such devices are commonly housed in an electrical fixture consisting of a container and cover made of heavy-gauge metal, the two halves being securely connected so that any flame arising from an explosion inside the fixture cannot propagate outside the fixture to ignite the external environment.

Because a power source contained in the fixture delivers large voltage currents, it is often desirable for purposes of safety to include a circuit breaker or disconnect switch so that the power source receptacle may be de-energized before a plug is inserted or removed. However, it is foreseeable that the operator of an electrical machine might forget to turn off the circuit breaker or disconnect switch before inserting or removing a plug from the fixture receptacle, thereby running the risk of experiencing an electrical shock.

Fixtures of the type here under consideration are typically provided with what is known as a dead front receptacle. These devices provide true dead front safety in that an electrical plug cannot be inserted or withdrawn from the receptacle unless the power to the receptacle is initially turned off at the circuit breaker or disconnect switch. Moreover, once the electrical plug is withdrawn from the dead front receptacle, that receptacle cannot be re-energized unless an electrical plug is fully re-inserted therein. In other words, the handle or operating lever of the circuit breaker or disconnect switch cannot be moved from the "off" to the "on" position unless the plug is fully inserted within the dead front receptacle.

Prior art interlock mechanisms of the type here under discussion include many moving parts thus increasing the cost of manufacture. Many of these interlock mechanisms are complex thereby increasing the chances of encountering a malfunction of one form or the other.

SUMMARY OF THE INVENTION

The present invention provides a new and improved interlock mechanism for a dead front receptacle.

A primary object of the present invention is the provision of an improved interlock mechanism for a dead front receptacle, such mechanism having a minimum of parts thus lending itself for inexpensive manufacture.

Another object of the present invention is the provision of an interlock mechanism of the type described which is highly reliable in operation.

Still another object of the present invention is the provision of an interlock mechanism for a dead front receptacle which includes additional safety features over the prior art devices.

These and other objects and advantages of the invention will become apparent from the following specification disclosing a preferred embodiment.

DESCRIPTION OF A PREFERRED EMBODIMENT

Figure 17:
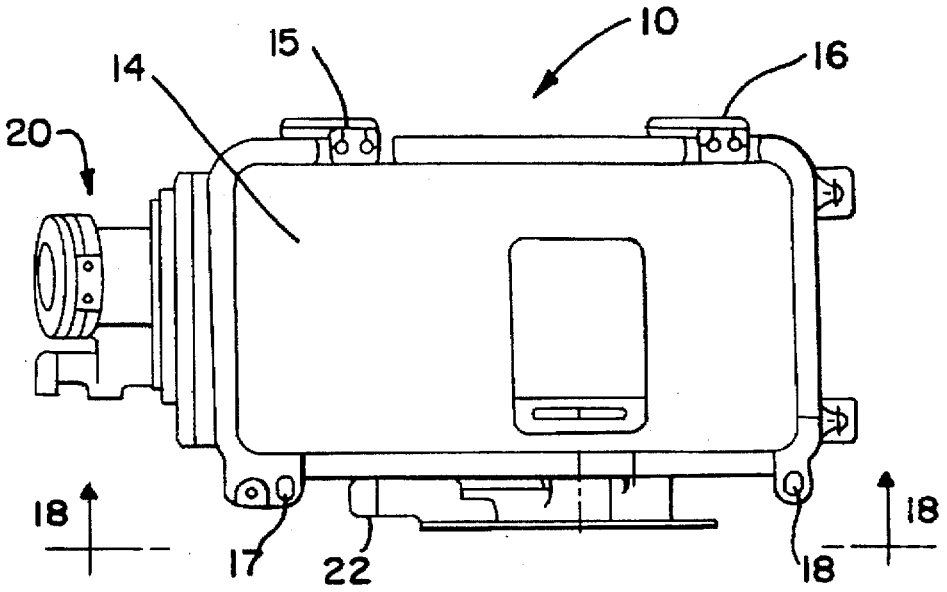
FIG. 17 is a top plan view of an enclosure with a dead front receptacle and including the interlock mechanism of the present invention.
Figure 18:
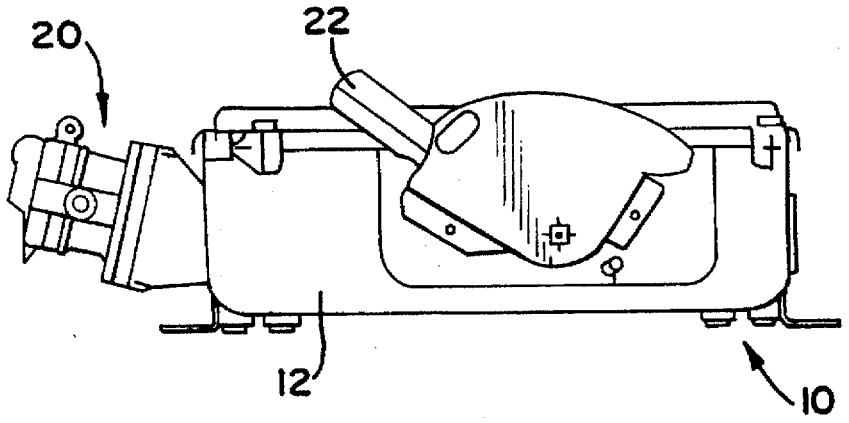
FIG. 18 is a side view as seen along the line 18—18 of FIG. 17.

Referring first to FIGS. 17 and 18, a single throw safety switch with an interlocked dead front receptacle is generally designated 10. A disconnect switch (not shown) is contained within an enclosure consisting of a base housing member 12 having a lid 14 secured thereto as by means of hinges 15 and 16. Lid 14 may be bolted to the base member 12 by a pair of fasteners 17, 18. Preferably a seal is provided between the lid 14 and the base enclosure member 12 thereby permitting the disconnect switch to be used in hazardous locations. Housing 12 mounts a dead front receptacle, generally designated 20.

The disconnect switch is opened and closed by a manually operated lever 22. Lever 22 controls an actuating mechanism (not shown) contained within the enclosure; this actuating mechanism includes a switch interlock rod 24. It will be understood that when the lever 22 is swung for closing the disconnect switch contacts, the interlock rod will be moved axially as indicated by the arrow 25 from the position shown in FIG. 1 to the position shown in FIG. 3. When the operating lever 22 is swung to disconnect the contacts, i.e., open the switch, the interlock rod will be moved axially in an opposite direction, as shown by the arrow 26, from the position shown in FIG. 3 to the position shown in FIG. 1.

The dead front receptacle 20 includes a cylindrical opening 28 receiving a fixedly mounted connector 30 connected with conduits 32; these conduits extend to the disconnect switch, preferably through a fuse assembly. A plug 34, of a type well known to those skilled in the art, includes a cylindrical formation 35 having an opening (not shown) adapted to receive the connector 30. It will be understood that the connector 30 and the plug 34 include interengaging terminals for establishing an electrical connection between the plug 34 and the connector 30, all as well known to those skilled in the art. It will be noted that the cylindrical portion 35 of the plug 34 includes an aperture 36 in the exterior surface thereof.

An actuator shaft 40 is rotatably mounted within the housing 41 of the dead front receptacle. The housing 41 has a boss 42 supporting the outer end of the actuating shaft 40 which mounts a handle 44. The inner end of the actuating shaft, which is received within the base housing member 12, mounts an actuator arm 46 by means of fasteners 47 (FIG. 3).

Figure 16:
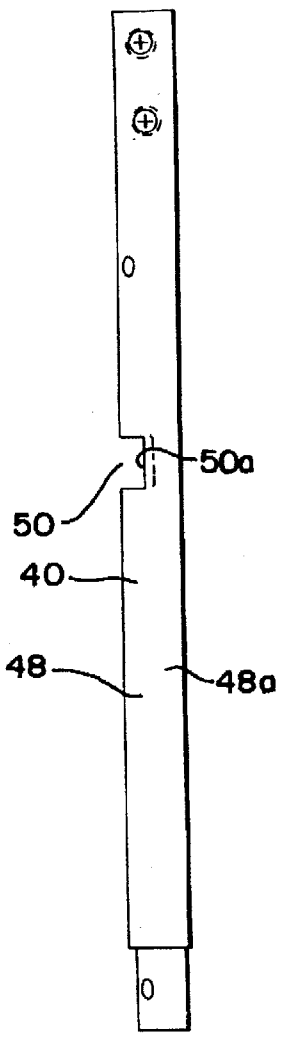
FIG. 16 is a view of the actuator shaft rotated 90-degrees from the position shown in FIG. 13.
Figure 14:
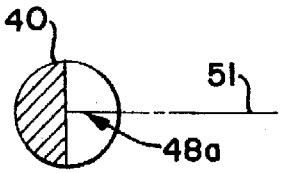
FIG. 14 is a section taken along the line 14—14 of FIG. 13.
Figure 13:
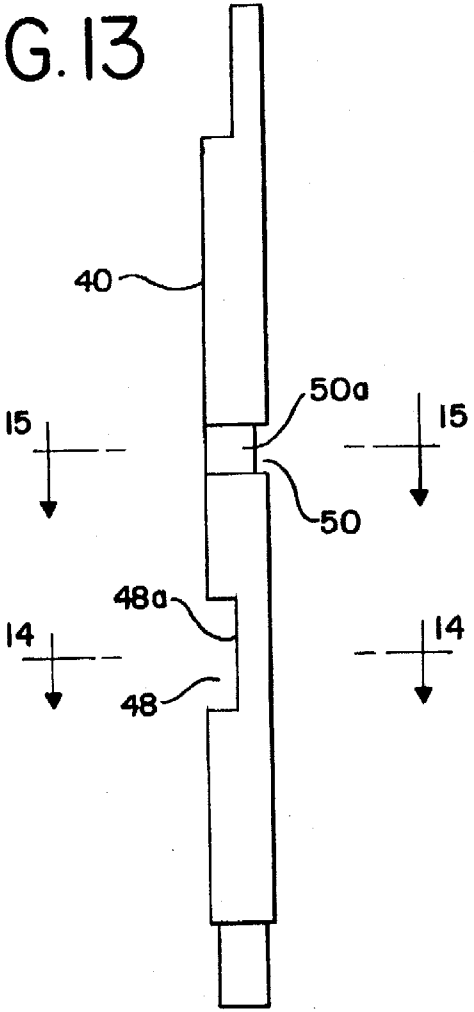
FIG. 13 is an enlarged top view of the actuator shaft.

Referring to FIGS. 13, 14 and 16, the actuator shaft 40 includes a first slot 48 defining a planar cam follower surface 48*a*. The planar cam follower surface 48*a* is substantially diametrically disposed with respect to the actuator rod 40.

Figure 15:
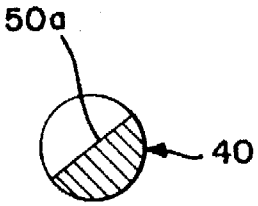
FIG. 15 is a section taken along the line 15—15 of FIG. 13.

As seen in FIGS. 13, 15 and 16, the actuator rod includes a second slot 50 defining a planar cam follower surface 50*a*. The planar surface 50*a* is diametrically disposed with respect to the actuator rod 40. Referring to FIGS. 14 and 15, line 51 is perpendicular to the plane defined by the cam follower surface 48*a*. The planar surface 50*a* is preferably disposed at an angle in the range of 25 to 30 degrees from the line 51.

Figure 2:
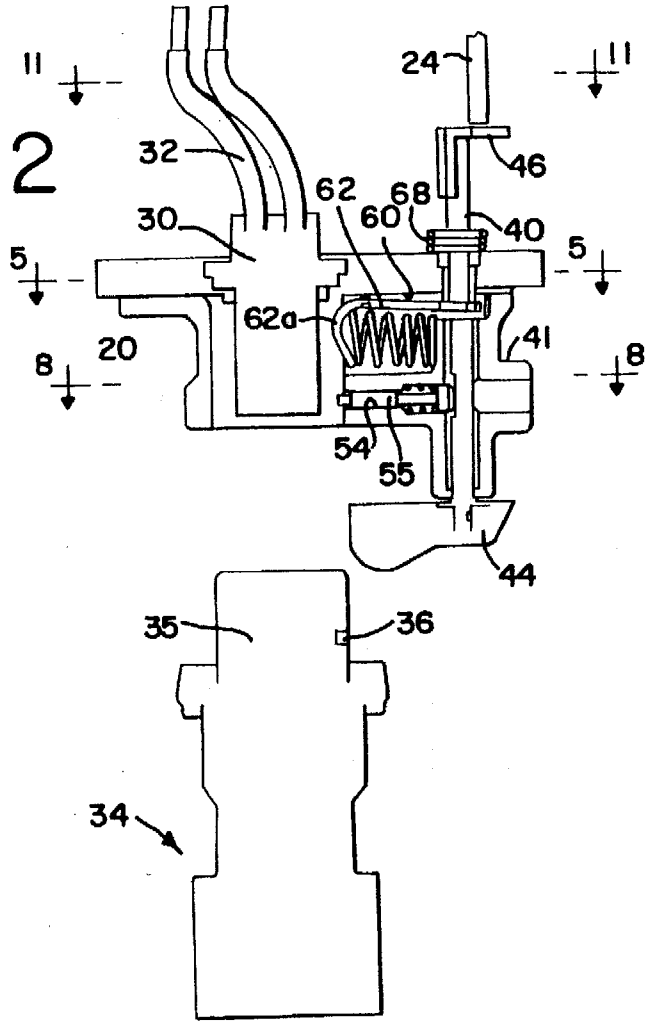
FIG. 2 is a top plan view similar to FIG. 1 but showing the interlock mechanism in a different position.
Figure 1:
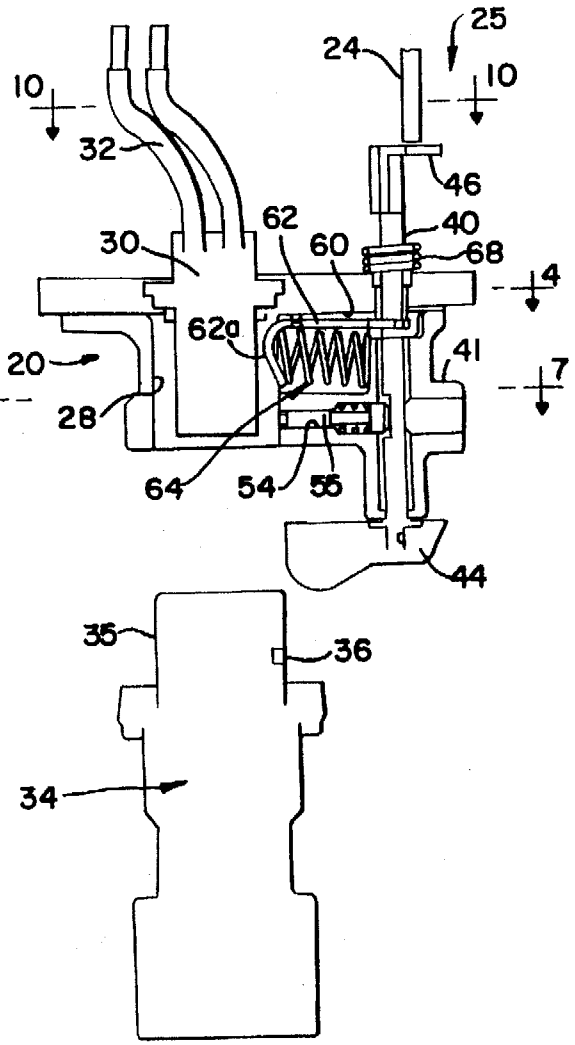
FIG. 1 is a top plan view of the interlock mechanism of the present invention and showing a plug in disengaged relationship with the dead front receptacle.
Figure 3:
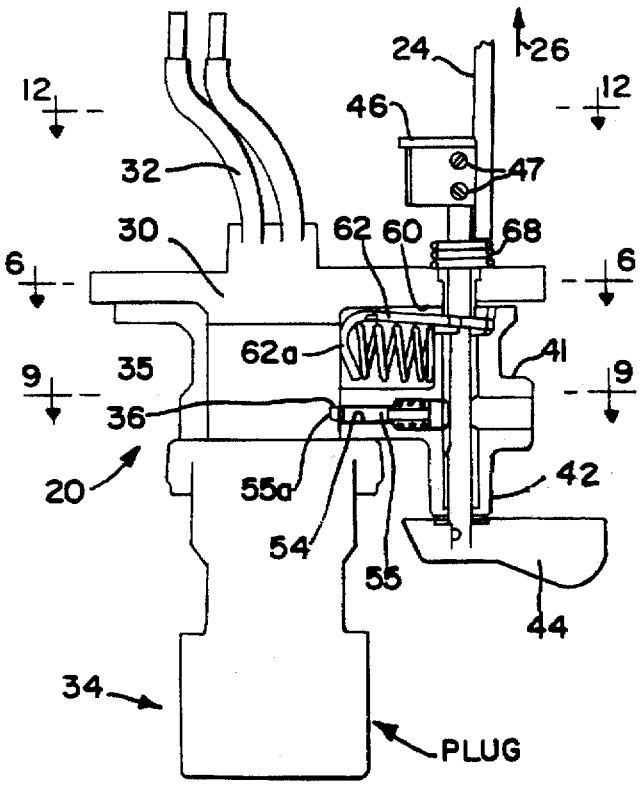
FIG. 3 is a top plan view similar to FIG. 1 but showing the interlock mechanism in a still different position and also showing a plug fully received in the dead front receptacle.
Figure 7:
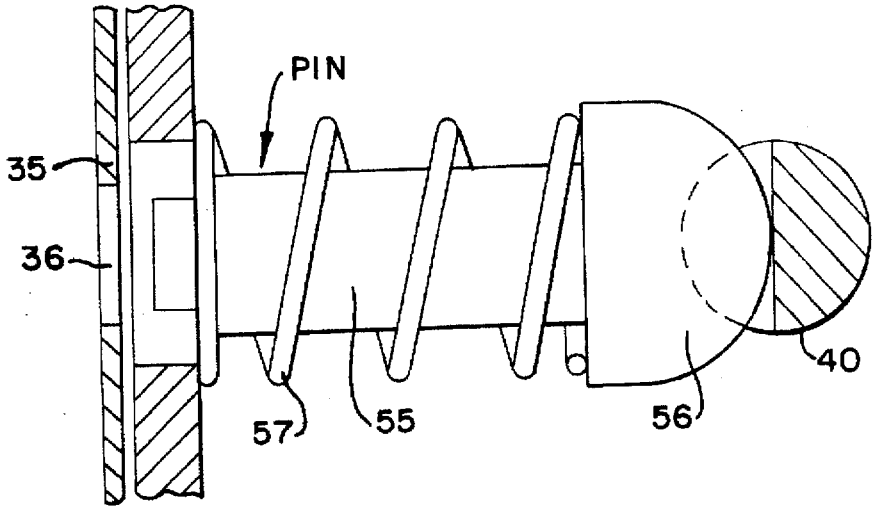
FIG. 7 is an enlarged fragmentary section taken along the line 7—7 of FIG. 1.
Figure 8:
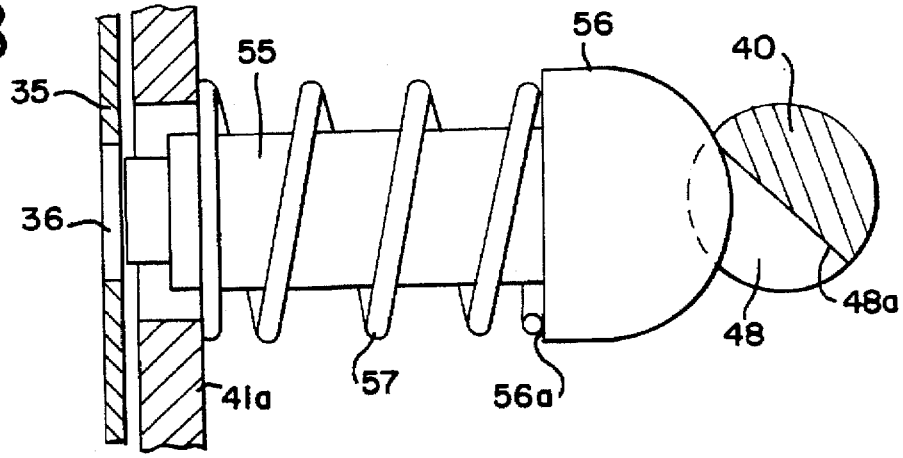
FIG. 8 is an enlarged fragmentary section taken along the line 8—8 of FIG. 2.
Figure 9:
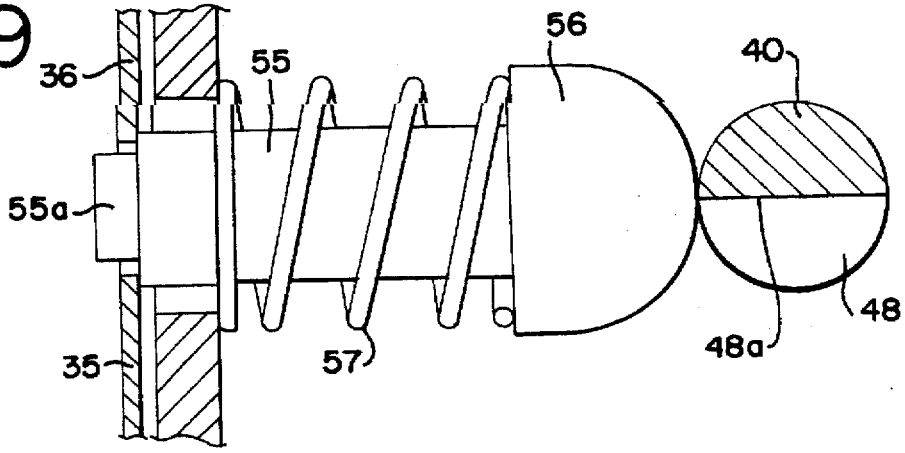
FIG. 9 is an enlarged fragmentary section taken along the line 9—9 of FIG. 3.

Referring primarily to FIGS. 1–3, housing 41 of the dead front receptacle includes a first opening 54 receiving a locking pin 55. As best seen in FIGS. 7–9, the locking pin 55 includes a hemispherical head 56. A coil spring 57 has one end thereof in abutting engagement with a shoulder 56*a* defined by the head 56; the other end of the coil spring is in abutting engagement with first wall portion 41*a* of the dead front receptacle. It will be understood that the coil spring 57 constantly urges the locking pin to the right to maintain the head 56 in engagement with the actuator rod in the vicinity of the recess 48. The locking pin 55 includes a reduced-in-diameter portion 55*a;* the distal end of the portion 55*a* is adapted to be received within the aperture 36 formed in the cylindrical wall 35 of the plug 34.

The housing 41 includes a second opening 60 receiving a slider 62. The slider includes a bent end portion 62*a*. The opening 60 also receives a coil spring 64. One end of the spring 64 abuts the inner surfaces of the rounded portion 62*a* of the slider; the other end of the spring 64 abuts an interior wall surface of the dead front housing 41. It will be understood that the spring 64 constantly urges the slider 62 to the left as seen in the drawings such that the rounded portion 62*a* of the slider will extend into the cylindrical opening 28 of the dead front receptacle.

Figure 4:
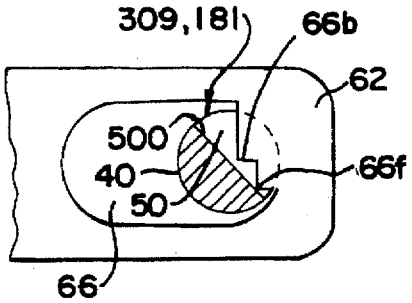
FIG. 4 is an enlarged fragmentary section taken along the line 4—4 of FIG. 1.
Figure 5:
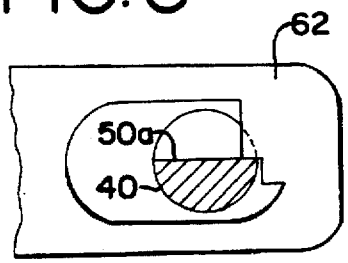
FIG. 5 is an enlarged fragmentary section taken along the line 5—5 of FIG. 2.
Figure 6:
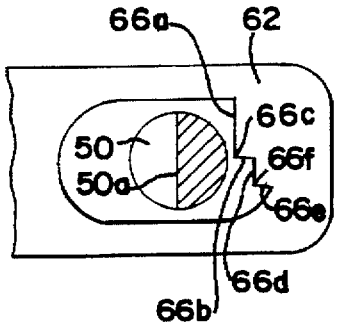
FIG. 6 is an enlarged fragmentary section taken along the line 6—6 of FIG. 3.

As best seen in FIGS. 4, 5 and 6, the slider 62 includes an opening 66 which receives the actuator shaft 40 in the vicinity of the slot 50. The opening 66 defines inner edge surfaces 66*a* and 66*b* which join at a right angle to form a first cam follower formation 66*c*. The opening 66 also defines planar edge surfaces 66*d* and 66*e* which join at a right angle to form a second cam follower formation 66*f*.

Referring to FIGS. 1–3, a coil spring 68 is mounted on the actuator shaft 40. Opposite ends of the spring 68 are suitably connected to the actuator shaft 40 and the housing 41 such that the spring 68 constantly urges the actuator shaft 40 to rotate in a counterclockwise direction as shown in FIGS. 4–12.

Figure 10:
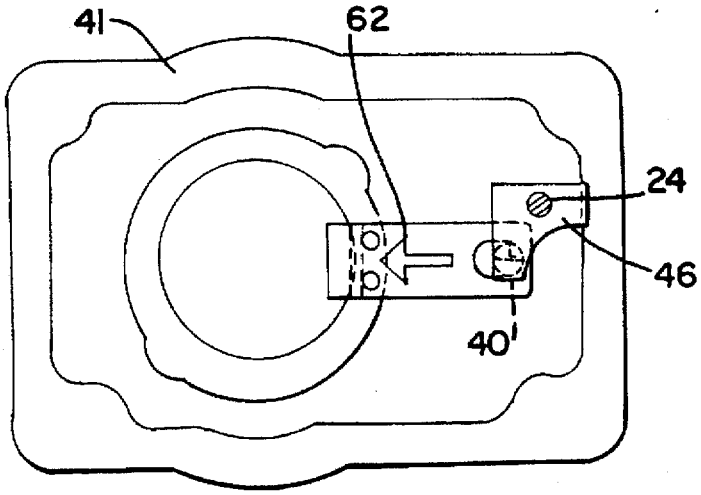
FIG. 10 is a section taken along the line 10—10 of FIG. 1.

Let us assume that the disconnect switch is in the open condition. Thus, the operating lever 22 will be in the position shown in FIGS. 17 and 18. Let us further assume that the plug 34 has not yet been inserted into the cylindrical opening 28 of the dead front receptacle. Accordingly, the condition of the various parts will be as shown in FIGS. 1, 4 and 10. It will be noted from FIG. 1 that the end of the switch interlock rod 24 is in abutting or interfering relationship with the actuator arm 46. Thus, the operating lever 22 cannot be moved to the closed position. As noted in FIG. 4, the cam follower formation 66*f* is in engagement with the planar surface 50*a* of the actuator shaft thus preventing this shaft from rotating in the counterclockwise direction under the influence of the coil spring 68.

Let us now assume that the plug 34 is fully inserted within the cylindrical opening 28 in the dead front housing 41. The cylindrical wall 35 of the plug 34 will come into engagement with the slider portion 62*a* thus forcing the slider to the right. This movement of the slider causes separation of the cam formations 66*c* and 66*f* from the cam follower surface 50*a* thus allowing the torsion spring 68 to rotate the actuator shaft 40 counterclockwise from the position shown in FIG. 4 to the position shown in FIG. 6. In comparing FIGS. 10 and 12, it is seen that this rotation of the actuator shaft causes the actuator arm 46 to move out of the path of movement of the interlock rod 24. Hence, the operating lever arm 22 may be swung to close the switch causing movement of the interlock rod from the position shown in FIG. 1 to the position shown in FIG. 3.

Referring to FIGS. 7–9, it will be understood that this counterclockwise rotation of the actuator shaft resulting from insertion of the plug 34, will cause the distal end 55*a* of the locking pin to be inserted within the aperture 36 of the cylindrical wall 35 of the plug 34. Accordingly, it will not be possible to withdraw the plug 34 from the dead front receptacle after the switch has been closed.

Let us now assume that it is desired to withdraw the plug 34. Of course, the plug cannot be withdrawn as long as the distal end 55*a* of the locking pin is received within the aperture 36 in the cylindrical portion 35 of the plug 34. As will be seen from the description below, the locking pin is withdrawn from the aperture by grasping the handle 44 and rotating the same (and the actuating shaft 40) in a clockwise direction. However, the handle 44 and actuating shaft 40 cannot be rotated clockwise as long as the switch is in the closed or on position. This is so because the interlock rod 24 will be in interfitting engagement with the actuating arm 46 when the switch is closed thereby preventing rotation of the handle 44. Consequently, the actuating lever 22 must be swung to open the switch. In response to such movement, the interlock rod 24 will be axially moved in the direction of the arrow 26 from the position of FIG. 3 to the position of FIG. 1.

The operator will then grasp the handle 44 for rotating the actuator shaft 40 in a clockwise direction as seen in FIGS. 4–12. Such rotation will cause the locking pin 55 to move from the position of FIG. 9 to the position of FIG. 7. Consequently, the plug 34 may now be removed from the de-energized dead front receptacle.

Figure 11:
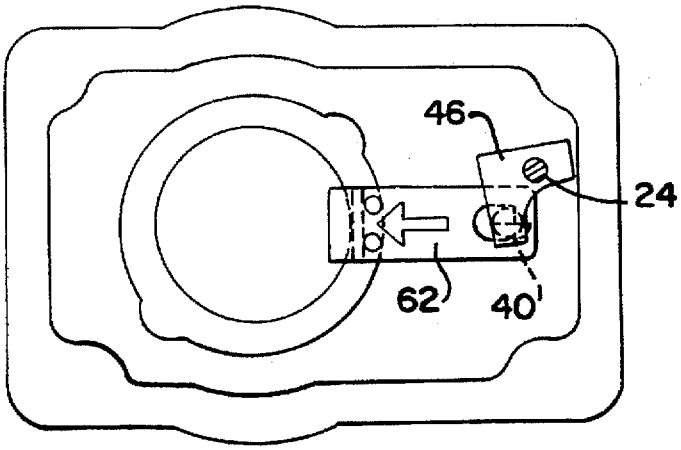
FIG. 11 is a section taken along the line 11—11 of FIG. 2.
Figure 12:
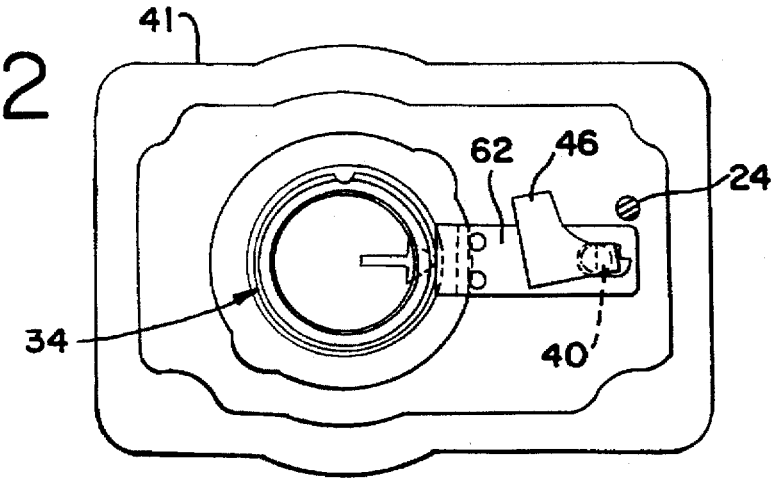
FIG. 12 is a section taken along the line 12—12 of FIG. 3.

FIGS. 5 and 8 illustrate a situation which will result if the operator does not turn the handle 44 to its full clockwise position. As noted from FIG. 8, although the pin 55 has not been fully withdrawn, the distal end 55*a* has been removed from the aperture 36 and consequently the plug 34 can be withdrawn. As seen in FIG. 5, the wall 66*b* holds the actuator shaft in the position shown. Referring to FIG. 11, when the actuator shaft is in the position of FIG. 5, the actuator arm 46 will still be in an interfering position with respect to the interlock rod 24 and consequently the disconnect switch cannot be turned on. Accordingly, the provision of the second cam follower defined in part by the edge **66*b* provides a safety feature to prevent closing of the switch when the locking pin has been withdrawn just enough to permit removal of the plug 34**.

While a preferred embodiment has been shown and described in accordance with the present invention, it is to be understood that the invention is not to be limited to the embodiment shown but is susceptible to numerous changes and modifications as known to persons skilled in the art. Therefore, the invention is not to be limited to the details shown and described herein but includes all changes and modifications which are within the scope of the following claims.

I claim:

1. An interlock mechanism for a disconnect switch of the type mounted within an enclosure having a dead front receptacle, wherein an operating lever is pivotally mounted by the enclosure for movement back and forth between open and closed positions, and wherein the dead front receptacle includes a cylindrical opening for receiving a plug including a cylindrical wall with an aperture therein, said interlock mechanism comprising:

(a) an interlock rod connected with said operating lever, said interlock rod being movable in a first axial direction when said operating lever is moved from the open position to the closed position and in a second opposite axial direction when said operating lever is moved from the closed position to the open position;

(b) an actuator shaft adapted to be rotatably mounted by said enclosure in adjacent relationship with the dead front receptacle and in parallel spaced relationship with the central axis of said cylindrical opening, said shaft having a first end within the enclosure and a second end disposed exteriorly of the enclosure;

(c) an actuator arm mounted on said first end of the actuator shaft;

(d) a handle mounted on said second end of said actuator shaft for rotating the latter back and forth between first and second positions;

(e) spring means mounted by the enclosure and connected with said actuator shaft for urging the latter to rotate from its first position to its second position, said actuator arm being in interfitting relationship with said interlock rod when said actuator shaft is in its first position thereby preventing movement of said interlock rod in its first direction, said actuator arm permitting axial movement of the interlock rod in its first direction when said actuator shaft is in its second position;

(f) first and second cam means on said actuator shaft;

(g) said enclosure having first and second openings respectively communicating with said cylindrical opening;

(h) a locking pin adapted to be slidably mounted in said first opening and having first and second ends;

(i) first biasing means urging said first end of the locking pin into engagement with said first cam means, said first cam means serving to force said second end of the locking pin into the aperture in said plug when said actuator shaft is rotated from its first position to its second position;

(j) a slider adapted to be received within said second opening and having a first end and a second end, said slider being slidably mounted in said second opening for movement back and forth between first and second positions;

(k) second biasing means urging said slider toward said first position such that the first end of the slider projects into the cylindrical opening, said slider having cam follower means on said second end thereof and positioned for engagement with said second cam means to hold said actuator shaft in its first portion when the slider is in its first position, whereby engagement of the cylindrical wall of the plug with the first end of said slider forces said slider toward its second position thereby moving said cam follower out of engagement from said second cam means whereupon said spring means will rotate said actuator shaft from its first position to its second position thereby permitting movement of the interlock rod in its first direction, such rotation of the actuator shaft causing said first cam means to force said second end of the locking pin into said plug aperture.

2. The interlock mechanism according to claim 1 further defined by:

(a) said second cam means being defined by a recess in a portion of said actuator shaft; and (b) said cam follower means being defined by a first formation forming part of a wall in an opening in said slider, said opening receiving said portion of said actuator shaft.

3. The interlock mechanism according to claim 2 wherein said recess defines a planar surface arranged for engagement by said first formation for holding said actuator shaft in its first position.

4. The interlock mechanism according to claim 2 further defined by:

(a) rotation of said actuator shaft from its second position through an intermediate position to its first position by manual turning of said handle causing said first cam means to allow said first biasing means to withdraw said second end of said locking pin from the aperture in said plug;

(b) said cam follower means including a second formation arranged to engage said recess for momentarily holding said actuator shaft in its intermediate position; and (c) said actuator arm remaining in interfitting relationship with said interlock rod when said actuator shaft is in its intermediate position.

* * * * *

UNITED STATES PATENT AND TRADEMARK OFFICE

CERTIFICATE OF CORRECTION

PATENT NO. : 5,670,763

DATED : September 23, 1997

INVENTOR(S) : Charles Jeffrey Spencer

It is certified that error appears in the above-indentified patent and that said Letters Patent is hereby corrected as shown below:

Assignee:

On title page, item [73] should read as follows:

--Appleton Electric Company--

Signed and Sealed this

Thirtieth Day of June, 1998

*Attest:*

*Attesting Officer*

Bruce Lehman

BRUCE LEHMAN

*Commissioner of Patents and Trademarks*